US005560849A

United States Patent [19]

Shankwalkar et al.

[11] Patent Number: 5,560,849

[45] Date of Patent: Oct. 1, 1996

[54] SYNTHETIC ESTER LUBRICANT HAVING IMPROVED ANTIWEAR PROPERTIES

[75] Inventors: Sundeep G. Shankwalkar, Plainsboro, N.J.; Douglas G. Placek, Fairless Hills, Pa.

[73] Assignee: FMC Corporation, Philadelphia, Pa.

[21] Appl. No.: 363,186

[22] Filed: Dec. 23, 1994

[51] Int. Cl.$^6$ ..... C10M 137/04

[52] U.S. Cl. ..... 508/423; 252/78.5

[58] Field of Search ..... 252/49.8, 78.5

[56] References Cited

U.S. PATENT DOCUMENTS

| | | | |
|---|---|---|---|
| 3,169,925 | 2/1965 | Mahoney . | |
| 3,240,704 | 3/1966 | Nelson et al. | 252/49.8 |
| 3,254,027 | 5/1966 | Matson et al. | 252/49.8 |
| 3,318,811 | 5/1967 | Conradi et al. | 252/49.8 |
| 3,375,305 | 3/1968 | Patton, Jr. et al. | 252/49.8 |
| 4,033,887 | 7/1977 | DeRoocker . | |
| 5,204,394 | 4/1993 | Gosens et al. . | |
| 5,281,741 | 1/1994 | Gunkel et al. . | |
| 5,520,090 | 8/1950 | Barrett . | |

FOREIGN PATENT DOCUMENTS

| | | |
|---|---|---|
| 521628 | 6/1992 | European Pat. Off. . |

*Primary Examiner*—Jacqueline V. Howard

*Attorney, Agent, or Firm*—Patrick C. Baker; Robert L. Andersen

[57] ABSTRACT

The antiwear properties of synthetic ester lubricants intended for use at high temperatures (150° C. to 350° C.) are improved by adding to the lubricants a hydrocarbon insoluble, synthetic ester soluble, aryl diphosphate ester composition containing a major amount of an aryl diphosphate ester of the formula:

$$(RO)_2\overset{\overset{\displaystyle O}{\|}}{P}-O-Ar-O-\overset{\overset{\displaystyle O}{\|}}{P}(OR)_2$$

wherein Ar is unsubstituted or alkyl ($C_1$–$C_{12}$) substituted arylene and R is unsubstituted or alkyl ($C_1$–$C_{12}$) substituted aryl.

22 Claims, No Drawings

SYNTHETIC ESTER LUBRICANT HAVING IMPROVED ANTIWEAR PROPERTIES

This invention relates to synthetic ester lubricants having improved antiwear properties.

High temperature lubrication, for example at about 150° C. to 350° C., requires a synthetic ester lubricant such as a polyol ester, a diester or certain phosphate esters. Antiwear compounds are conventionally added to lubricants to enhance the lubricity. Unfortunately, currently available antiwear additives degrade too rapidly at high use temperatures. For example, neutral triaryl phosphate esters are used as antiwear additives in lubricants and hydraulic fluids but due to lower thermal stability, may not be used in high temperature applications.

European Patent Application 521628 filed Jun. 15, 1992 and published Jan. 7, 1993 discloses a mixture of (i) a hydrocarbon soluble aryl phosphate and (ii) a hydrocarbon soluble aryl polyphosphate as an antiwear agent for addition to middle distillate fuels, such as diesel, jet and turbine fuels; to lubricants including diester lubricants; and to functional fluids such as hydraulic fluids. The antiwear agent mixtures exemplified are the reaction products of phenol and/or alkyl-substituted phenol with POCl3 in the presence of a Lewis acid catalyst to form an intermediate, followed by reaction of the intermediate with resorcinol and/or alkyl-substituted resorcinol, again in the presence of a Lewis acid catalyst. The mixtures contain substantial proportions of byproduct triaryl phosphate, such as triphenyl phosphate (TPP). These byproducts are low in molecular weight relative to other isomers and hence are volatile. This renders the mixtures unstable, particularly for high temperature lubricant applications.

U.S. Pat. No. 5,281,741 to Gunkel et al describes a manufacturing technique for reducing the TPP content, of a mixture similar to that of EPA 521628, to less 0.than 5%. Only flame retardant applications are disclosed.

U.S. Pat. No. 4,033,887 to De Roocker describes a mixture of a major amount of a trialkyl or triaryl orthophosphoric acid ester and a viscosity index improving amount of a transesterification product of a dihydroxy aromatic compound, such as resorcinol, and a phosphorus or phosphoric acid ester. The transesterifacation product may contain components similar to those of EPA 521628. The mixture is said to be a functional fluid having utility as a lubricant or hydraulic fluid.

U.S. Pat. No. 2,520,090 to Barrett describes aryl diphosphate esters (polyphosphates of divalent aryl hydrocarbons) which have low solubility in mineral oils and other petroleum hydrocarbons. The esters are said to be useful as flame retardants and plasticizers in nitrocellulose and other cellulose derivatives.

A high temperature lubricant composition having improved antiwear properties and resistance to degradation has now been discovered. The lubricant composition comprises a synthetic ester basestock and as antiwear additive a hydrocarbon insoluble, synthetic ester soluble, aryl diphosphate ester composition containing no more than 2 wt % triaryl phosphate. Surprisingly, although the aryl diphosphate ester composition in comparison with triaryl phosphate esters is stable at high temperature lubricating conditions, it gives poor antiwear results when used per se as a high temperature lubricant. In contrast, the aryl diphosphate ester composition when used in minor amounts in a synthetic ester basestock lubricant, provides excellent antiwear at high temperature.

In another aspect of the invention, the hydrocarbon insoluble synthetic ester soluble, aryl diphosphate ester composition may be formulated as a concentrate in a liquid carrier compatible with synthetic ester lubricant basestocks, for addition to the synthetic ester basestock in amounts effective to improve antiwear properties of synthetic ester lubricant end products.

In still another aspect of the invention, lubricant compositions of the invention are used as the lubricant in lubrication systems of engines.

The aryl diphosphate ester composition comprises a major amount (at least 50% by weight) of an aryl diphosphate ester of the formula (I):

$$(RO)_2\overset{\overset{\displaystyle O}{\|}}{P}-O-Ar-O-\overset{\overset{\displaystyle O}{\|}}{P}(OR)_2 \qquad \text{I}$$

wherein Ar is unsubstituted or substituted arylene wherein the substituents comprise one or more alkyl ($C_1$–$C_{12}$) groups which may be the same or different. The R groups comprise unsubstituted or substituted aryl groups, same or different, wherein the substituents comprise alkyl ($C_1$–$C_{12}$) groups, with one or more alkyl substituents on each aryl group. The alkyl groups may be the same or different.

Representative unsubstituted arylene groups are the residues of dihydroxy compounds such as hydroquinone, resorcinol and catechol, and the residues of polynuclear phenols such as diphenylol methane, diphenylol dimethyl methane, dihydroxy diphenyl, p,p'-dihydroxy diphenyl sulfone, dihydroxy naphthalene, and the like. Representative R groups are phenyl, biphenyl, phenoxyphenyl, and the like. Alkyl substituents on Ar and R include one or more groups such as methyl, ethyl, n-propyl, isopropyl and t-butyl. In the case of substituted R groups, such groups represent the residues of monohydroxy compounds such as cresol, xylenol, cuminic alcohol, and the like.

Since the number, carbon content, structure and position of the alkyl substituents will influence solubility, both in hydrocarbons and in synthetic esters, the Ar and R groups will be selected, using routine screening procedures, to provide the requisite solubility and insolubility.

The aryl diphosphate ester composition of the invention will have a viscosity of at least 140 cSt at 100° F. (about 38° C.), preferably 150 cSt at 25° C. In addition to the aryl diphosphate ester and the triaryl phosphate byproduct, the composition will normally also contain minor amounts (about 0.01–10 wt. %) of a diaryl hydroxyaryl phosphate component and oligomer byproducts of unknown composition. The proportions of the latter component and oligomers can be controlled by reactant ratios and other process conditions as described in U.S. Pat. No. 5,281,741 and the amounts are reflected in total acid number of the aryl diphosphate ester compositions.

It is believed that the low acidity, hydrocarbon insolubility, synthetic ester solubility, high viscosity and other properties provided by the aryl diphosphate ester composition in synthetic ester lubricant basestocks are achieved by controlling the process conditions for production of the aryl diphosphate ester composition as in U.S. Pat. No. 5,281,741 but with further reduction of triaryl phosphate ester content to no more than 2 wt %. In the process of preparation, an excess of phosphorus oxytrichloride (POCl3) is first reacted with a dihydroxy aryl compound, such as resorcinol, in the presence of a Lewis acid catalyst. Unreacted POCl3 is then removed, followed by reaction of the intermediate with a monohydroxy aryl compound, such as phenol, again in the presence of a Lewis acid catalyst. Finally, the reaction product is treated with alkali without hydrolyzing the product. The total acidity of the reaction product is thereby reduced to 0.15 mg KOH/g or less measured in accordance with ASTM D974.

Dihydroxy aryl compounds useful in preparing the aryl diphosphate ester antiwear additives include resorcinol, hydroquinone, bisphenols such as bisphenol A, bisphenol methanes and biphenols, and substituted dihyroxy aryl compounds wherein the substituents include the alkyl groups previously described. Suitable monohydroxy aryl reactants include phenol and substituted phenols wherein the substituents include alkyl. The reaction product can be a liquid or solid depending on whether the dihydroxy aryl reactant is unsymmetrical or symmetrical, respectively.

Other conditions of reaction, including reaction medium, temperature, product workup and separation, are as described in U.S. Pat. No. 5,281,741.

The synthetic ester basestocks include polyol esters, diesters and phosphate esters. Representative polyol esters are the reaction products of monocarboxylic acids (C2–C12 or higher) and polyols such as neopentyl glycol, trimethylolpropane, pentaerythritol, dipentaerythritol, complexes and mixtures of any of the foregoing, and the like. Representative diesters include reaction products of monohydroxy alcohols (C1–C6 or higher, both acyclic and cyclic) and dicarboxylic acids such as adipic, azelaic, sebacic, phthalic acid, dimer acids, mixtures of any of the foregoing, and the like. The phosphate esters are those used as lubricants per se and generally comprise triaryl phosphates, trialkyl phosphates, phosphates having both aryl and substituents (sometimes called "mixed" phosphate esters), and any blends of the foregoing. The phosphate esters thus include tricresyl phosphate, trixylenyl phosphate, tributyl phosphate, tributoxyethyl phosphate, trioctyl phosphate, isopropyl phenyl phosphate, and the like, and any blends thereof.

The amount of aryl diphosphate ester composition to be added to the synthetic ester basestock is a minor amount but sufficient to provide improved antiwear properties. Typically, this amount may range from about 0.1 to about 10% by weight based on the weight of the synthetic ester, preferably about 0.5–5 wt %. Higher or lower amounts may be used depending on the environment of use and other additives in the lubricant composition.

The aryl diphosphate ester additive composition may also be blended with carrier liquids, compatible with synthetic ester lubricant basestocks, to provide concentrates suitable for addition to synthetic ester basestocks to form synthetic ester lubricant end products. Such concentrates may facilitate mixing, blending, pouring or transferring (bulk or line) of the aryl diphosphate ester additive composition. Typically, the liquid carrier for the aryl diphosphate ester will be a portion of synthetic ester intended as the basestock for the end product synthetic ester lubricant but other carriers may be employed, together with other lubricant additives. Addition of the concentrates to synthetic ester lubricant basestocks to form end product lubricants may be batchwise, for example from unit containers of concentrates sold at retail, or may be added by metering at production or distribution sites. The amount of aryl diphosphate ester composition in the concentrate may vary, depending on concentrate properties for ease of blending, such as viscosity. Generally, about 10% to 90% by weight of aryl diphosphate ester composition in the carrier liquid is suitable, more usually about 20% to 50% by weight.

Other agents which may be added to the end product lubricant compositions or to the concentrates are well known and include lubricity agents, other anti-wear additives, antioxidants, metal passivators, rust and/or corrosion inhibitors, viscosity index (VI) improvers, detergents/dispersants, defoamers/antifoamers, emulsion modifiers, seal swell agents, tackifiers, stabilizers, dyes, and perfumes and other odor masks. Lubricity agents include fatty acids and their metal salts or esters and oxidized paraffins. Anti-wear additives include phosphate esters, zinc dialkyl dithiophosphates, and phosphorized fats and olefins. Extreme pressure (EP) agents include chlorinated paraffins olefins and sulfurized paraffins, olefins or fats. Antioxidants include hindered phenols, aromatic amines and zinc dialkyl dithiophosphates. Corrosion inhibitors include metal sulfonates, metal phenate sulfrides, acid phosphate esters and zinc dialkyl dithiophosphates. Metal passivators include benzotriazoles and phosphate esters. VI improvers include methacrylate polymers, styrene butadiene copolymers and polyisobutylenes. Defoamers/antifoamers include silicones and organic copolymers. Detergent/dispersants include metal sulfonates, metal phenate sulfides and polyamine succinimides. Seal swell agents include alkyl phosphate esters and aromatic hydrocarbons and esters. Tackifiers include VI type polymers and aluminum soaps of fatty acids. The invention is further described and illustrated in the following non-limiting examples. Throughout this specification and claims all parts and percentages are by weight, all temperatures are centigrade, acid numbers are total acid numbers of aryl diphosphate ester compositions as mg KOH/g measured by the procedure of ASTM 974-87, and residuals % are by high pressure liquid chromatographic (HPLC) analysis.

EXAMPLES

Example 1

Two aryl diphosphate ester compositions (A,B) were prepared as described in U.S. Pat. No. 5,281,714 from the reactants set forth in Table 1 below to provide the composition and properties indicated, wherein "TPP" is triphenyl phosphate and "TPPOH" is diphenyl resorcinol phosphate.

TABLE 1

Aryl Diphosphate Ester Compositions

| | A | B |
|---|---|---|
| Reactants | PO $Cl_3$<br>resorcinol<br>phenol | PO $Cl_3$<br>hydroquinone<br>phenol |
| Residual TPP, % | 1.85 | <2 |
| Residual TPPOH; % | 1.15 | |
| Total Acid No., mg KOH/G | 0.06 | 3.1 |
| Viscosity, cSt @ 100° F. | 150 | solid |
| Solubility | sol. in synthetic esters, insol. in hydrocarbon lubes | sol. in synthetic esters, insol. in hydrocarbon lubes |

Example 2

The aryl diphosphate ester additive compositions A and B of Example 1 were blended with synthetic ester lubricant basestocks to provide 2 wt. % of additive in the basestocks. The polyol ester basestock was a predominantly $C_9$ pelarqonic acid ester of pentaeryritol (Emery 2918—Henkel Corp.) The diester basestock was diisodecyl adipate (Emery 2970—Henkel Corp.). Four ball wear tests (ASTM 2266, 75° C., 1200 rpm, 60 min.) on the lubricant compositions gave the results set forth in Table 2 below in comparison with basestocks without the aryl diphosphate ester additives. Significant improvements in antiwear due to the additives are evident.

TABLE 2

| Antiwear Properties of Lubricant Composition (Wear scar, mm) | | | |
|---|---|---|---|
| | Synthetic Ester | | |
| Basestock | Additive A | Additive B | No Additive |
| Polyol ester | 0.44 | 0.40 | 0.76 |
| Diester | 0.45 | 0.41 | 0.92 |

Example 3

The antiwear properties of synthetic ester lubricants containing aryl diphosphate ester composition A of Example 1 were compared with antiwear properties of the same synthetic ester basestocks as in Example 2 but containing neutral triaryl (mono)phosphate ester compositions. The test procedure (ASTM 2266) was the same as in Example 2 with differences as indicated. The results are given in Table 3 where it will be seen that antiwear imparted by the aryl diphosphate ester compositions of the invention is superior.

TABLE 3

| Antiwear Properties of Lubricant Compositions | | | |
|---|---|---|---|
| | Wear Scar, mm 1 hour, 40 kg | Wear Scar, mm 2 hour, 40 kg | Wear Scar, mm 1 hour, 50 kg |
| Polyol ester (100%) | 0.76 | 0.86 | |
| Polyol ester + 2% C | 0.59 | — | |
| Polyol ester + 2% D | 0.58 | — | |
| Polyol ester + 2% A | 0.44 | 0.49 | |
| Diester (100%) | 0.92 | — | 1.15 |
| Diester + 2% C | 0.63 | — | 0.84 |
| Diester + 2% A | 0.45 | — | 0.66 |

C = Tricresyl phosphate
D = Mixture of triphenyl phosphate, diphenyl mono t-butylphenyl phosphate, phenyl di-t-butylphenyl phosphate, tri-t-butylphenyl phosphate, 20/45/30/5 average % composition.

Example 4

The high temperature stability (volatility and oxidative stability) of the aryl diphosphate ester composition A of Example 1 was measured and compared with that of various neutral triaryl (mono) phosphate esters including tricresyl phosphate (C) and a mixed phosphate ester (E) comprising tri-isopropylphenyl phosphate, phenyl dipropylphenyl phosphate, diphenyl monopropyl-phenyl phosphate and triphenyl phosphate (14/24/30/18 avg. %). The test procedure was thermal analysis using differential scanning calorimetry (DSC) and thermogravimetric analysis (TGA) in oxygen gas in accordance with ASTM E537 and D3850. The results are set forth in Table 4. The superior thermal stability of composition A is evident in the higher temperatures for the 5% and 10% weight losses because these temperatures imply lower volatility and greater resistance to oxidation due to lower concentrations of byproducts including triphenyl phosphate.

TABLE 4

| High Temperature Stability | | | |
|---|---|---|---|
| | | Weight Loss | |
| Composition | Oxidation Temp., °C. | 5% Temp., °C. | 10% Temp., °C. |
| C | 215 | 255 | 278 |
| E | 215 | 252 | 272 |
| A | over 400 | 365 | 400 |

We claim:

1. A lubricant comprising a synthetic ester basestock and a minor amount of a hydrocarbon insoluble, synthetic ester soluble, aryl diphosphate ester composition effective to improve the antiwear properties of the base stock, the aryl diphosphate ester composition containing no more than 2 wt % triaryl phosphate and comprising a major amount of an aryl diphosphate ester of the formula

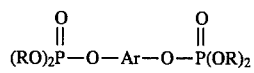

I wherein Ar is unsubstituted or substituted arylene, wherein the substituents comprise one or more alkyl ($C_1$–$C_{12}$) groups, same or different, and the R groups comprise unsubstituted or substituted aryl, same or different, wherein the substituents comprise one or more alkyl ($C_1$–$C_{12}$) groups, same or different.

2. The lubricant of claim 1 wherein Ar is a hydroquinone, catechol or resorcinol residue and R is phenyl, cresyl, xylyl, or any combination thereof.

3. The lubricant of claim 2 wherein Ar is a hydroquinone residue and R is phenyl, cresyl or any combination thereof.

4. The lubricant composition of claim 1 wherein Ar is a resorcinol residue and R is phenyl, cresyl or any combination thereof.

5. The lubricant of claim 1 wherein Ar is a catechol residue and R is phenyl, cresyl or any combination thereof.

6. The lubricant of claim 1 wherein Ar is a resorcinol residue and R is phenyl.

7. The lubricant of claim 1 wherein Ar is a hydroquinone residue and R is phenyl.

8. The lubricant of any of claims 1–7 wherein the acid number of the aryl diphosphate ester composition does not exceed 0.15 mg KOH/g.

9. The lubricant of any of claims 1–7 wherein the viscosity of the aryl diphosphate ester composition is at least 140 cSt at 100° F.

10. The lubricant of any of claims 1–7 wherein the acid number of the aryl diphosphate ester composition does not exceed 0.15 mg KOH/g and the viscosity of the aryl diphospate ester composition is at least 140 cSt at 100° F.

11. The lubricant of any of claims 1–7 wherein the synthetic ester basestock is selected from a diester, a polyol ester, a phosphate ester different from aryl diphosphate esters, and any mixtures thereof.

12. The lubricant of any of claims 1–7 wherein the amount of the aryl diphosphate ester composition is in the range of 0.5 to 5 wt % based on, the weight of the basestock.

13. The lubricant of any of claims 1–7 additionally containing one or more additives selected from an antioxidant, a corrosion inhibitor, a metal passivator, a viscosity index modifier, a defoamer, an antifoamer, a detergent, a dispersant, an emulsion modifier, a seal swell agent, a tackifier, a colorant and an odor masking agent.

14. A lubricant comprising a synthetic ester basestock and an amount of a hydrocarbon insoluble, synthetic ester soluble, aryl diphosphate ester composition effective to improve the antiwear properties of the basestock, and wherein the aryl diphosphate ester composition is produced by the reaction of phosphorus oxytrichloride, a dihydroxy compound selected from hydroquinone, catechol and resorcinol, and a monohydroxy compound selected from phenol, cresol and xylenol, the composition containing no more than 2 wt % aryl phosphate, having an acid number not exceeding 0.15 mg KOH/g, and having a viscosity of at least 140 cSt at 100° F.

15. A concentrate for addition to a synthetic ester lubricant to improve the high temperature antiwear properties thereof, comprising a hydrocarbon insoluble, synthetic ester soluble, aryl dephosphate ester composition and a liquid carrier compatible with synthetic ester lubricant basestocks, the aryl diphosphate ester composition containing no more than 2 wt % triaryl phosphate and comprising an aryl diphosphate ester of the formula $$(RO)_2\overset{\overset{\displaystyle O}{\|}}{P}-O-Ar-O-\overset{\overset{\displaystyle O}{\|}}{P}(OR)_2$$

16. The concentrate of claim 15 wherein the amount of aryl diphosphate ester composition is about 10% to 90% by weight of the concentrate.

17. The concentrate of claim 15 wherein Ar is a hydroquinone, catechol or resorcinol residue and R is phenyl, cresyl, xylyl or any combination thereof.

18. The concentrate of claim 15 wherein Ar is a resorcinol residue and R is phenyl.

19. The concentrate of claim 15 wherein Ar is a hydroquinone residue and R is phenyl.

20. In a method for reducing wear in an engine lubrication system, the improvement which comprises utilizing as the lubricant the lubricant of any of claims 1–7.

21. The concentrate of claim 15 wherein the acid number of the aryl diphosphate ester composition does not exceed 0.15 mg KOH/g.

22. The concentrate of claim 21 wherein the viscosity of the aryl diphosphate ester composition is at least 140 cSt at 100° F.

* * * * *